United States Patent [19]

Swinbanks

[11] Patent Number: 4,637,048

[45] Date of Patent: Jan. 13, 1987

[54] METHODS AND APPARATUS FOR REDUCING NOISE BY CANCELLATION

[75] Inventor: Malcolm A. Swinbanks, Pentlands Close, England

[73] Assignee: National Research Development Corp., London, England

[21] Appl. No.: 708,812

[22] Filed: Mar. 5, 1985

[30] Foreign Application Priority Data

Mar. 7, 1984 [GB] United Kingdom ..... 8405914

[51] Int. Cl.[4] ..... G10K 11/16

[52] U.S. Cl. ..... 381/71

[58] Field of Search ..... 381/71, 73, 94, 56; 181/206

[56] References Cited

U.S. PATENT DOCUMENTS

| | | | |
|---|---|---|---|
| 3,936,606 | 2/1976 | Wanke | 381/71 |
| 4,044,203 | 8/1977 | Swinbanks | 381/71 |
| 4,153,815 | 5/1979 | Chaplin | 381/71 |
| 4,527,282 | 7/1985 | Chaplin | 381/71 |

FOREIGN PATENT DOCUMENTS

| | | | |
|---|---|---|---|
| 1918437 | 10/1970 | Fed. Rep. of Germany | 181/206 |
| 2358436 | 5/1974 | Fed. Rep. of Germany | 181/206 |
| 1190317 | 10/1959 | France | 181/206 |
| 1304329 | 1/1973 | United Kingdom . | |
| 1357330 | 6/1974 | United Kingdom | 181/206 |
| 2079373 | 1/1982 | United Kingdom | 181/206 |

OTHER PUBLICATIONS

"An Algorithm for Dressing a Broadband Active Sound Control System", Journal of Sound and Vibration, (1982) 80(3), 373–380, C. F. Ross.

"The Ambiguity of Acoustic Sources—A Possibility for Active Control?", Journal of Sound and Vibration (1976) 48(4), 475–483, A. J. Kempton.

*Primary Examiner*—Gene Z. Rubinson
*Assistant Examiner*—L. C. Schroeder
*Attorney, Agent, or Firm*—Cushman, Darby & Cushman

[57] ABSTRACT

Some degree of cancellation of noise from an annular noise source can be achieved by using an annular noise generator surrounding the source and in antiphase therewith. However due to the dimensions of the annulus, constructive interference may occur at frequencies of interest. In the present invention an annular noise source is surrounded by inner and outer annular noise generators generating sounds which are in antiphase and in phase respectively with sounds from the noise source. Also sounds from the inner generator are of twice the amplitude of those from the source and the outer generator. In effect over a considerable frequency range, the noise source and the outer generator have a mean position which coincides with the inner generator and together they generate sounds which are of the same amplitude but opposite phase to sounds from the generator. Thus destructive interference occurs in the said frequency range. The invention may also be applied to two spaced apart noise sources or arrangements of sources which can be regarded as annular or as two spaced sources.

18 Claims, 7 Drawing Figures

METHODS AND APPARATUS FOR REDUCING NOISE BY CANCELLATION

Figure 1:
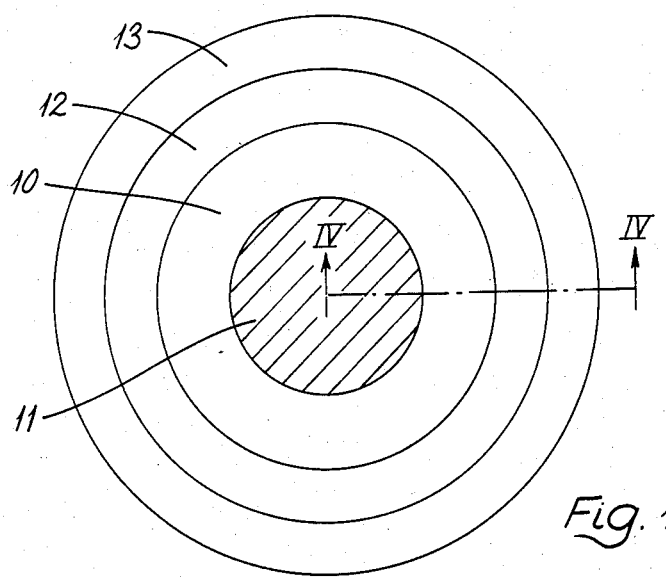

The present invention relates to methods and apparatus for reducing noise from spaced similar noise sources by cancellation using sound generators. In a more specific form, the invention relates to the reduction of noise from sources in which noise emanates from an annular exit. Some exhaust ducts have, or can be adapted or constructed to have, this form of exit.

Where the exit of an exhaust duct is annular in cross-section some sound cancellation can be achieved by surrounding the exit with an annular array of antiphase noise sources so that the array behaves as similarly as possible to the noise source. However significant differences between propagation of the source and the array occur due to their different radii; the output from a single annular source, in the plane of the cross-section of the exhaust, consists of components generated by both the nearest elements of the source and the farthest source elements, the latter having to travel across the diameter of the annulus. Destructive interference occurs between these separate components at frequencies which are related to the difference in distance travelled by each component, with the result that the total response for a complete annulus exhibits maxima and minima at frequencies which are inversely proportional to the diameter of the annular source. If two concentric annular sources of differing diameter are driven in antiphase, the fact that the maxima and minima of response occur at different frequencies for the two separate annuli results in imperfect overall cancellation.

One way of overcoming this problem which has occurred to the present inventor is to use two active arrays of sound sources, one inside the annular duct exit and one outside giving a mean diameter for the active array equal to that of the unwanted source diameter. The disadvantage of this approach is that the inner array is exposed to the full temperature of the exhaust gases which may for example be 500° C.

According to a first aspect of the present invention there is provided apparatus for reducing noise from a noise source which comprises, or can be regarded as comprising, two spaced apart noise sources substantially in phase or in antiphase and of equal amplitude at a frequency, or respective frequencies, at which noise reduction is required, the apparatus comprising first generating means for generating sounds at first locations on the line joining the sources adjacent to the sources but not between them, and second generating means for generating sounds at second locations on the line, adjacent to the first locations but not between them, the sounds generated at each of the first locations and each of the second locations at the said frequency or frequencies being, in operation, substantially twice the amplitude of, and substantially of equal amplitude to, respectively, sound from each of the noise sources, and having a phase relationship which tends to cancel and reinforce, respectively, sound from the adjacent noise source.

According to a second aspect of the present invention there is provided a method for reducing noise from a source which comprises, or can be regarded as comprising, two spaced apart noise sources substantially in phase or in antiphase and of equal amplitude at a frequency, or respective frequencies, at which noise reduction is required, the method comprising generating sounds at first locations on the line joining the sources adjacent to the sources but not between them, and generating sounds at second locations on the line adjacent to the first locations but not between them, the sounds at each of the first locations and each of the second locations at the said frequency or frequencies being substantially twice the amplitude of and substantially of equal amplitude to, respectively, noise from each of the noise sources, and having a phase relationship which tends to cancel and reinforce, respectively, sound from the adjacent noise source.

The sounds generated at the first and second locations may be in antiphase and phase, respectively, with the sounds from the adjacent noise sources.

The first and second aspects of the invention find application where sound from two noise sources, or equivalent is to be reduced by cancellation and it is not possible to locate cancelling sound generators between the sources. In these aspects of the invention sounds generated at the first location can be regarded as being trapped between equal sounds generated by the noise sources and generated at the second location so that these two latter sources of sound have the same mean location in the said line as the sounds generated at the first locations. The sounds from the noise sources and the second locations are in antiphase with and together of equal amplitude to, the sounds generated at the first locations. As will be described later nulls and maxima still occur in the response but at higher frequencies.

The invention is of application to annular noise sources because the said line can be regarded as a diameter of such a source or the annular noise sources can be regarded as two spaced apart sources. Thus the two noise sources may take up any configuration from "point sources" to an annular noise zone where the two sources have merged.

According to a third aspect of the present invention, therefore, there is provided apparatus for reducing noise from an annular noise source, as hereinafter defined, or which may be regarded as from a said annular noise source, wherein the noise is, over the whole source, substantially of equal amplitude and substantially in phase at a frequency, or respective frequencies, at which noise reduction is to take place, the apparatus comprising first generating means for generating sounds over a first annular zone, as hereinafter defined, surrounding and adjacent to the noise source, and second sound generating means for generating sounds over a second zone which is at least partially annular and at least partially surrounds and is adjacent to, the first generating means, the sounds from the first and second zones at the said frequency or frequencies being, in operation, at least along one transverse axis, substantially twice the amplitude of and substantially of equal amplitude to respectively, sound from the noise source, and having a phase relationship which tends to cancel and reinforce, respectively, sounds from the noise source.

According to a fourth aspect of the present invention there is provided a method for reducing noise from an annular noise source, as hereinafter specified, or which may be regarded as from a said annular noise source, wherein the noise is, over the whole source, substantially of equal amplitude and substantially in phase at a frequency, or respective frequencies, at which noise reduction is to take place, the method comprising generating sounds over a first annular zone, as hereinafter specified, surrounding and adjacent to the noise source, and generating sounds over a second zone which is at least partially annular and at least partially surrounds and is adjacent to the first zone, the sounds from the first and second zones at the said frequency or frequencies being, at least along one transverse axis, substantially twice the amplitude of, and substantially of equal amplitude to, respectively, sound from the noise source and having a phase relationship which tends to cancel and reinforce, respectively, sounds from the noise source.

The sounds generated at the first and second zones may be in antiphase and phase, respectively, with the sounds from the noise source.

By using the third and fourth aspects of the invention the need to place sound generators within an annular exhaust is avoided and any high temperatures which may occur do not affect the sound generators to the same extent. The noise source and the sounds generated in the second annular zone may be regarded as trapping and cancelling the noise generated in the first annular zone, since the mean diameter of the noise source and the second annular zone equals that of the first annular zone.

In this specification "annular" means having regularly shaped but not necessarily circular inner and outer boundaries. Thus an elliptical zone is annular as is a zone with triangular or rectangular inner and outer boundaries. Further "annular" applies to three dimensional arrangements where the inner boundary is in three dimensions and encloses an inner three dimensional zone and the outer boundary is also in three dimensions and encloses and is spaced from the inner boundary.

In the case of an elliptical noise source it may not be necessary for the second zone to extend completely round the first zone so long as the zones exist and have their full effect along and adjacent to the major axis of the ellipse. As the second zone approaches the minor axis the sounds it generates may decrease in amplitude until the amplitude is zero and the amplitude of the sounds generated by the first zone may also decrease in the region of the minor axis so that, at the minor axis, it equals that of the noise source. The major axis of the ellipse is a critical dimension since this is where constructive interference first occurs, limiting the upper frequency at which satisfactory cancellation can be achieved. Along the minor axis simple cancellation using the first locations may only be required because constructive interference does not occur until a relatively high frequency is reached which may be above the frequency at which such interference occurs along the major axis, with full cancellation according to the invention. Whether or not full cancellation is required depends on the eccentricity of the ellipse.

Where a number of noise sources occur in a zone and it is undesirable or difficult to place sound generating means in the zone, the present invention can be employed either by carrying out a theoretical summation of the sources into two sources or an extended annular source, or by considering the major dimension of the zone and providing cancellation according to the first or second aspects of the invention.

At very low frequencies it is not necessary to employ the invention because the dimensions involved are such that only destructive interference occurs. However at low frequencies more cancellation power is often required and so the double amplitude of sounds in the first locations or annular zones can be put to good effect by including a "crossover" network in driving the first and second sound generating means with the result that at low frequencies the first and second sound generating means are in antiphase with the noise source but at higher frequencies the phases specified in the various aspects of the invention are taken up.

Figure 6:
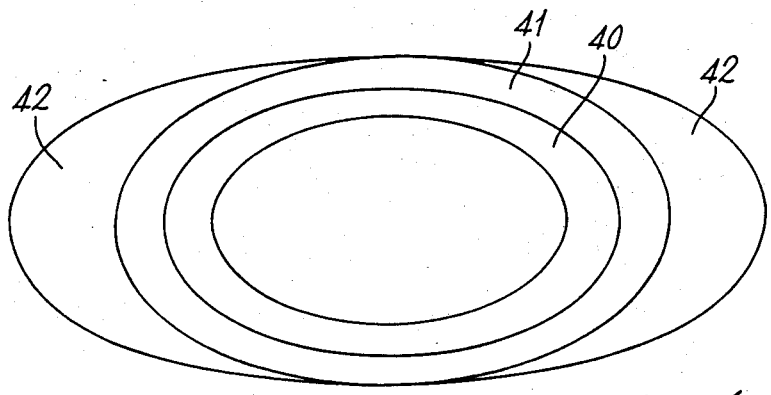
Figure 2A:
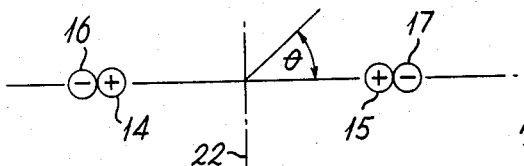
Figure 2B:
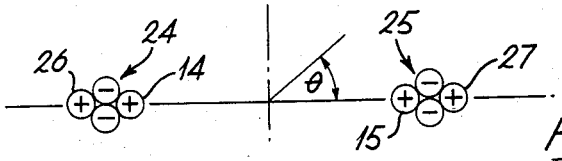
Figure 3:
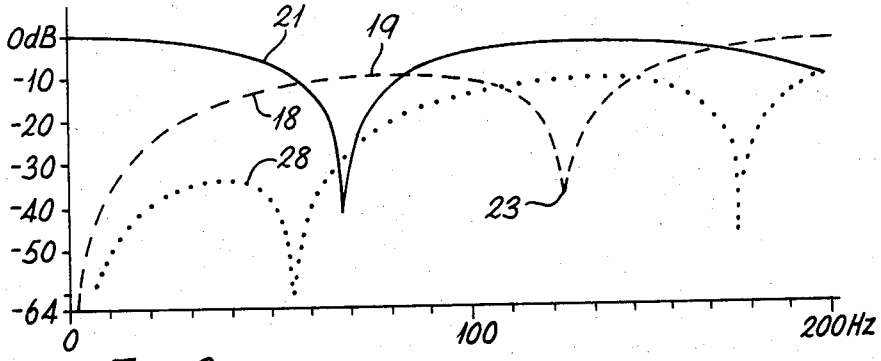
Figure 4:
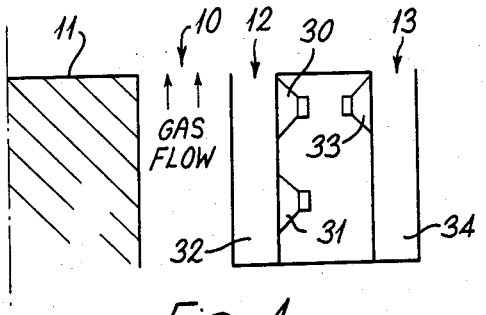
Figure 5:
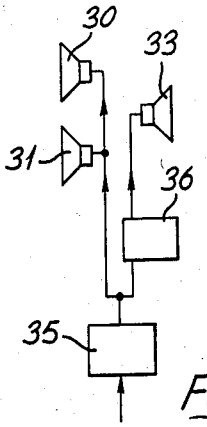

Certain embodiments of the invention will now be described, by way of example, with reference to the accompanying drawings, in which:

FIG. 1 is a schematic end view of the exit of an exhaust duct with sound reduction according to the invention, FIG. 2*a* shows point noise sources and point cancellation sources in an illustrative configuration, FIG. 2*b* shows point noise sources and point cancellation sources in a configuration according to the present invention, FIG. 3 is a graph showing comparative noise outputs at various frequencies with different configurations, FIG. 4 is a partial cross-section of the arrangement of FIG. 1 along the line IV—IV, FIG. 5 shows an example of the way in which loudspeakers of FIG. 4 can be driven through a "crossover" network, and FIG. 6 is a schematic view of an annular elliptical noise source with sound reduction according to the invention.

In FIG. 1 the annular exit 10 of the gas turbine exhaust surrounds a solid zone 11, so that exhaust gas flows only from the exit 10. The gas turbine exhaust may be a duct some 30 feet (approximately 9 meters) in length with an overall diameter of 10 feet (approximately 3 meters), the duct being connected at the other end from the exit either directly to a gas turbine or to a number of gas turbines. An exhaust of this type may initially have an annular zone such as the exit 10 but the inner zone 11 also permits gas flow, there being an annular wall between the inner and outer gas flows. Thus the first step in applying the present invention is in this situation to redesign the exhaust to take the form shown in FIG. 1. In some installations this can be carried out simply by sealing off the inner gas flow to give the sealed zone 11, but usually it is necessary to increase the annular zone of gas flow so that its total area equals that of the two former gas flow zones.

In accordance with the invention the exit 10 is surrounded by an annular active array 12 of sound generators which usually use loudspeakers as their active components. The array 12 is driven in antiphase with noise from the exit 10 and at twice its amplitude. Ways of deriving suitable drive signals for the loudspeakers are known but apart from the "crossover" described below, do not form part of the present invention. A suitable way of deriving a drive signal is described in "An Algorithm for Designing a Broadband Active Sound Control System" by C. F. Ross, Journal of Sound and Vibration (1982), 80(3), pages 373 to 380.

Briefly a microphone in the duct or at its exit provides a signal representative of the sound to be cancelled and this signal is modified by means of a filter to allow for the required phase adjustment, transmission paths (for example in the duct) and characteristics of the microphone and the loudspeakers, before being applied to the loudspeakers.

A second annular array 13 of sound generators surrounds the array 12 and in that part of the frequency band where the wavelength of sounds is comparable with the differences in the radii of the annular zone 10 and the arrays 12 and 13, the annular array 13 is driven in antiphase with the array 12 and at half its amplitude. At lower frequencies the array 13 is driven in phase with the array 12 as is explained below.

At the frequencies where the sounds from the exhaust exit 10 are in phase with sounds generated by the array 13 and of equal amplitude, the exit and the array 13 can theoretically be replaced by a single annular source of twice the amplitude with the same radius as the array 12 and in antiphase therewith. Thus over the range of frequencies where sounds from the zone 10 and the array 13 can be combined in this way goood noise cancellation occurs. In a typical installation the radii of the zone 10 and the arrays 12 and 13 are 4'2" (127 cms), 5'0" (152.4 cms) and 5'10" (177.8 cms), respectively.

An illustration of the type of response obtained from the arrangement shown in FIG. 1, theoretical responses based on an uncancelled output, and two linear arrangements shown in FIGS. 2*a* and 2*b* (the latter according to the invention) are shown in FIG. 3. In many respects the results for the behaviour of circular arrays will be similar to those for a linear arrangement because a circular array can be approximated by two separate point sources separated by 7/1Oths of the diameter of the array.

In FIGS. 2*a* and 2*b* the phase of noise or sound is represented by a + or − in a circle while amplitude is represented by the number of such circles.

FIG. 2*a* shows two in-phase noise sources 14 and 15 and two adjacent sound generators 16 and 17 which are of equal amplitude but in antiphase with the sources 14 and 15. A curve 18 in FIG. 3 shows the calculated noise level along the line joining the sources 14 and 15 for the arrangement of FIG. 2*a* but performance in any direction at an angle $\theta$ to this line will have the same form but with the frequency scale effectively expanded by a factor $1/\cos\theta$. Thus the worst case, in the sense that the maximum 19 occurs at its lowest frequency, is that shown in FIG. 3. Similar remarks as regards direction apply to the other curves of FIG. 3.

The arrangement of FIG. 2*a* provides an improvement over the theoretical response 21 for the noise sources 14 and 15 in the absence of the generators 16 and 17 but a maximum 19 occurs in the region of 70 Hz for dimensions corresponding to those mentioned in connection with FIG. 1, that is distances from the centre line 22 for the sources 14 and 15 of 4'2" and of 5'0" for the generators 16 and 17.

As has been mentioned, in isolation the pair of sources 14 and 15 generate an output signal whose amplitude is given by the curve 21. The sources 16 and 17 operating in isolation will also generate an output amplitude which is similar to that of the curve 21, but since the distance separating the sources 16 and 17 is greater than the distance separating sources 14 and 15, the first null in the amplitude of this output occurs at a proportionately lower frequency. As a result, when the outputs of sources 14 and 15 are combined in antiphase with the outputs of sources 16 and 17, imperfect cancellation takes place, because the two separate sets of output signals are not exactly matched in amplitude. Where the separate outputs are poorly matched in amplitude, maxima such as the maximum at 19 occur, while where the separate outputs are well-matched in amplitude, minima such as the minimum at 23 occur.

In the arrangement according to the invention of FIG. 2*b* generators 24 and 25 generate sounds which are in antiphase with noise from the sources 14 and 15 but are of twice their amplitude. Two further sound generators 26 and 27 generate sounds in phase with, and of the same amplitude, as the noise sources 14 and 15 so that the sources 14 and 15 together with the generators 26 and 27 can be regarded as cancelling the sounds produced by the generators 24 and 25. The response of the arrangement shown in FIG. 2*b* is theoretically as shown by the curve 28 in FIG. 3 and it will be seen that the first maximum comparable to that of the curve 19 occurs at a frequency of about 130 Hz, giving a considerable improvement over the arrangement of FIG. 2*a*.

Just as sounds from the two sources 14 and 15 of FIG. 2*a*, in the absence of the two sources 16 and 17, interfere destructively at some frequencies as seen from the curve 21, so two sources in antiphase interfere constructively at some frequencies. Where it is required to cancel noise from such sources at these frequencies, the arrangement of FIG. 2*b* may be used when modified as follows, assuming the phase of the source 15 can be represented as − (that is a minus sign): the sources 25 are of opposite phase (that is +) and the source 27 is of the same phase (that is −). Under such circumstances the output of the sources 14 and 15 alone are expected to be of similar form to curve 21 but with the null in the response occurring at 0 Hz. The corresponding curve may then be obtained by moving the vertical axis to coincide with the first null and displacing the frequency scale accordingly. It is expected that curves similar to the curves 19 and 28 can be obtained but with their origins also displaced in a comparable fashion.

The arrangement of FIG. 1 may be put into effect in the way shown in FIG. 4 where a cross-section along the line IV—IV of FIG. 1 is shown. The active array 12 comprises a group of loudspeakers two of which are shown at 30 and 31 so that for equal drive signals a double amplitude sound is produced in the duct 32 which leads sound to an exit for the array 12. Another group of loudspeakers, one of which 33 is shown projects sounds into a duct 34 which leads to an exit for the array 13.

As has been mentioned the invention is not required at very low frequencies up to, for example, 20 Hz because at these frequencies the differences between the radii of the zone 10 and the arrays 12 and 13 are not comparable with the wavelength of the sounds and therefore significant interference does not occur. However at these low frequencies more sound power cancellation is often required. To meet this requirement the loudspeakers of the two arrays 12 and 13 are driven through networks 35 and 36 as shown in FIG. 5. For simplicity only the loudspeakers 30,31, and 33 are shown but in a practical arrangement each of these loudspeakers represents a group of loudspeakers arranged in the appropriate array. A drive signal which can be derived in the way mentioned above is fed to the network 35 and then on to the network 36 and the loudspeakers. The networks 35 and 36 provide crossover and have the following transfer functions:

$$\frac{1 + i(f/f_o)}{3 + i(f/f_o)}, \text{ and } \frac{1 - i(f/f_o)}{1 + i(f/f_o)}, \text{ respectively,}$$

where $f_o$ is the crossover frequency, typically 10 to 20 Hz, f is the frequency of the incoming signal, and i is the operator $\sqrt{-1}$.

At frequencies below $f_o$ the three groups of loudspeakers represented by the loudspeakers 30, 31 and 33 are therefore driven in phase and with equal amplitudes but above the frequency $f_o$ the loudspeakers 30 and 31 and their respective groups are driven in antiphase to the loudspeaker 33 and its respective group. Also above the frequency $f_o$, the groups of loudspeakers corresponding to the loudspeakers 30 and 31 will provide sounds of twice the amplitude produced by the group of loudspeakers represented by the loudspeaker 33.

Noise reduction for the annular noise source 40 of FIG. 6 is achieved by an elliptical array 41 for generating sounds of twice the amplitude of those from the source 40 but in antiphase, and a partial elliptical array 42 for generating sounds in phase with and of the same amplitude as the array 40. Along the major axis, where interference effects become apparent at lower frequencies than along the minor axis, cancellation is according to the invention. Between the two axes the source 42 tapers to zero as shown in the drawing and as the minor axis is approached the amplitude of sound from the zone 42 also decreases to zero. At the same time the amplitude of sound from the zone 41 decreases to equal the amplitude of sound from the noise source 40. Thus along the minor axis where interference does not occur until relatively high frequencies are reached, the configuration corresponds to that of FIG. 2*a*.

The invention can be put into effect in many other ways than those specifically described above, some of these ways having been indicated earlier in the specification. For example a linear arrangement based on FIG. 2*b* is practical as are the other arrangements indicated earlier.

Both the linear arrangement of FIG. 2*b* (as shown and as modified with the phase of the sources 15, 25 and 27 reversed) and elliptical arrangements, such as that of FIG. 6, or other non-circular annular arrangements may be superimposed to allow cancellation of noise from more complex sources. In general the amplitudes of the unwanted sources are not necessarily equal and thus the amplitudes of sounds from the first and second sound generating means of individual systems according to the invention, in a combination of superimposed systems, are in general different.

I claim:

1. Apparatus for reducing noise from a noise source which can be regarded as comprising, two spaced apart noise sources substantially in phase or in antiphase and of equal amplitude at respective frequencies, at which noise reduction is required, the apparatus comprising first generating means for generating sounds at first locations on the line joining the sources adjacent to the sources but not between them, and second generating means for generating sounds at second locations on the line, adjacent to the first locations but not between them, the sounds generated at each of the first locations and each of the second locations at the said frequencies being, in operation, substantially twice the amplitude of, and substantially of equal amplitude to, respectively, sound from each of the noise sources, and having a phase relationship which tends to cancel and reinforce, respectively, sound from the adjacent noise source.

2. Apparatus according to claim 1 for noise sources which are in phase, wherein the sounds generated at the first and second locations or zones are in antiphase and phase, respectively, with sounds from the noise source or sources.

3. Apparatus according to claim 1 for noise sources which are in antiphase wherein the sounds generated at each of the first and second locations are in antiphase and phase respectively, with sounds from the adjacent noise source.

4. Apparatus according to claim 1 including a crossover network for use in driving the first and second generating means, the network being so constructed that for signals having frequencies at which destructive interference only occurs between the two noise sources, sounds from the first and second sound generating means are both in antiphase with the noise source, but at other frequencies, sounds from the first and second sound generating means tend to cancel and reinforce, respectively, sound from the noise sources.

5. Apparatus for reducing noise which may be regarded as from a noise source having regularly shaped inner and outer boundaries, wherein the noise is, over the whole source, substantially of equal amplitude and substantially in phase at respective frequencies, at which noise reduction is to take place, the apparatus comprising first generating means for generating sounds over a first zone surrounding and adjacent to the noise source, and second sound generating means for generating sounds over a second zone which at least partially surrounds and is adjacent to, the first generating means, the sounds from the first and second zones at the said frequencies being, in operation, at least along one transverse axis of the noise source, substantially twice the amplitude of and substantially of equal amplitude, to, respectively, sound from the noise source, and having a phase relationship which tends to cancel and reinforce, respectively, sounds from the noise source.

6. Apparatus according to claim 5 wherein the noise source and the first zone are annular, and the second zone is at least partially annular.

7. Apparatus according to claim 6 wherein the sounds generated at the first and second locations or zones are in antiphase and phase, respectively, with sounds from the noise source or sources.

8. Apparatus according to claim 6, wherein the annular noise source has circular inner and outer boundaries, and in operation, the sounds from the first and second zones are substantially twice the amplitude of, and substantially of equal amplitude to, respectively, sound from the noise source throughout the first and second zones.

9. Apparatus according to claim 6, wherein the annular noise source is elliptical.

10. Apparatus according to claim 9 wherein the radial dimension of the second zone decreases to zero in traversing from the major axis to the minor axis.

11. Apparatus according to claim 9, wherein in traversing from the major axis to the minor axis the amplitude of sound from the first zone falls to zero and the amplitude of sound from the second zone falls to equal that from the noise source.

12. Apparatus according to claim 6 including a crossover network for use in driving the first and second generating means, the network being so constructed that for signals having frequencies at which destructive interference only occurs between two maximally spaced parts of the annular noise source, sounds from the first and second sound generating means are both in antiphase with the noise source, but at other frequencies, sounds from the first and second sound generating means tend to cancel and reinforce, respectively, sound from the annular noise source.

13. Apparatus according to claim 1 in combination with at least one further said apparatus for reducing noise from a source which can be regarded as a combination of pairs of spaced apart noise sources.

14. Apparatus according to claim 5 in combination with at least one further said apparatus for reducing noise from a source which can be regarded as a combination of pairs of spaced apart noise sources.

15. A method for reducing noise from a source which can be regarded as comprising, two spaced apart noise sources substantially in phase or in antiphase and of equal amplitude at respective frequencies, at which noise reduction is required, the method comprising generating sounds at first locations on the line joining the sources adjacent to the sources but not between them, and generating sounds at second locations on the line, adjacent to the first locations but not between them, the sounds at each of the first locations and each of the second locations at the said frequencies being substantially twice the amplitude of and substantially of equal amplitude to, respectively, noise from each of the noise sources, and having a phase relationship which tends to cancel and reinforce, respectively, sound from the adjacent noise source.

16. A method for reducing noise source which may be regarded as from a noise source having regularly shaped inner and outer boundaries, wherein the noise is, over the whole source, substantially of equal amplitude and substantially in phase at respective frequencies, at which noise reduction is to take place, the method comprising generating sounds over a first zone, surrounding and adjacent to the noise source, and generating sounds over a second zone which at least partially surrounds and is adjacent to the first zone, the sounds from the first and second zones at the said frequencies being, at least along one transverse axis of the noise source, substantially twice the amplitude of, and substantially of equal amplitude to, respectively, sound from the noise source and having a phase relationship which tends to cancel and reinforce, respectively, sounds from the noise source.

17. A method according to claim 16 wherein the noise source and the first zone are annular, and the second zone is at least partially annular.

18. A method according to claim 15 used in combination with at least one other said method but relating to a noise source which can be regarded as comprising two additional spaced apart noise sources.

* * * * *